US006742801B1

(12) United States Patent
Dodge

(10) Patent No.: US 6,742,801 B1
(45) **Date of Patent: *Jun. 1, 2004**

(54) SNOWBOARD BOOT BINDING MECHANISM

(75) Inventor: David J. Dodge, Shelburne, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/510,796

(22) Filed: Feb. 23, 2000

Related U.S. Application Data

(63) Continuation of application No. 08/753,343, filed on Nov. 25, 1996, now Pat. No. 6,050,005, which is a continuation of application No. 08/674,976, filed on Jul. 3, 1996, now Pat. No. 5,941,555, which is a continuation of application No. 08/375,971, filed on Jan. 20, 1995, now abandoned.

(51) Int. Cl.[7] ..... A63C 9/081

(52) U.S. Cl. ..... 280/618; 280/14.22

(58) Field of Search ..... 280/613, 14.21, 280/14.22, 14.24, 623, 624, 625, 617, 618, 600

(56) References Cited

U.S. PATENT DOCUMENTS

| | | | | |
|---|---|---|---|---|
| 2,449,294 A | * | 9/1948 | Guindon | 36/34 R |
| 3,271,040 A | | 9/1966 | Spademan | |

(List continued on next page.)

FOREIGN PATENT DOCUMENTS

| | | | |
|---|---|---|---|
| AU | 255 325 | | 11/1964 |
| CH | 678494 | A5 | 9/1991 |
| DE | 3916233 | A1 | 11/1990 |
| DE | 296 01 682 | U1 | 5/1996 |
| EP | 0 059 022 | A2 | 9/1982 |
| EP | 0 397 969 | A1 | 11/1990 |
| EP | 0 398 794 | A1 | 11/1990 |
| EP | 0 680 775 | A1 | 5/1995 |
| FR | 2595050 | * | 9/1987 |
| FR | 2604913 | * | 4/1988 |
| FR | 2627993 | * | 9/1989 |
| FR | 2 628 981 | | 9/1989 |
| FR | 2643277 | * | 4/1990 |
| FR | 2660203 | * | 10/1991 |
| FR | 2689776 | * | 10/1993 |
| FR | 2 689 776 | A2 | 10/1993 |
| IT | 322456 | | 11/1934 |
| JP | 303728 | | 11/1995 |
| WO | WO 94/09660 | * | 5/1994 |

(List continued on next page.)

OTHER PUBLICATIONS

Translation of DE 296 01 682.
Translation of DE 2916233 A1.
Translation of JP 7–303728.
Translation of WO 96/36407.
Partial translation of JP 7–303728.

*Primary Examiner*—Bryan Fischmann
(74) *Attorney, Agent, or Firm*—Wolf, Greenfield & Sacks, PC

(57) ABSTRACT

A snowboard boot binding mechanism includes a base member having a recessed channel. A first plate is slidably attached to the base member. A first pair of engagement rods are fixedly attached to the first plate. Each of the first pair of engagement rods has a head disposed at an axial end of the rod for selectively engaging and locking a first bar attached to a first side of the snowboard boot. A second plate is fixedly attached to the base member. A second pair of engagement rods are fixedly attached to the second plate. Each of the second pair of engagement rods have a head disposed at an axial end of the rod for engaging and locking a second bar attached to a second side of the snowboard boot which is disposed opposite to the first side.

60 Claims, 3 Drawing Sheets

U.S. PATENT DOCUMENTS

| | | | | | |
|---|---|---|---|---|---|
| RE26,972 | E | | 10/1970 | Spademan | |
| 3,560,011 | A | | 2/1971 | Spademan | |
| 3,578,349 | A | | 5/1971 | Edmund | |
| 3,606,370 | A | | 9/1971 | Spademan | |
| 3,775,875 | A | | 12/1973 | Dvorsky | |
| 3,779,570 | A | | 12/1973 | Betschart | |
| 3,797,841 | A | | 3/1974 | McAusland | |
| 3,824,713 | A | | 7/1974 | Vaccari | |
| 3,869,136 | A | | 3/1975 | Jackson | 280/673 |
| 3,884,492 | A | | 5/1975 | Spaderman | 280/624 |
| 3,887,206 | A | | 6/1975 | Salomon | 280/637 |
| 3,900,204 | A | * | 8/1975 | Weber | 280/11.17 |
| 3,925,911 | A | * | 12/1975 | Erlebach | 36/117.4 |
| 3,957,280 | A | | 5/1976 | Turnheim et al. | 280/613 |
| 3,964,758 | A | | 6/1976 | Kent | 623/23.11 |
| 3,988,841 | A | | 11/1976 | Salomon | 280/613 |
| 4,026,045 | A | | 5/1977 | Druss | 36/108 |
| 4,042,257 | A | | 8/1977 | Salomon | 280/624 |
| 4,063,752 | A | | 12/1977 | Whitaker et al. | |
| 4,082,312 | A | | 4/1978 | Johnson | |
| 4,108,467 | A | | 8/1978 | Kreyenbuhl | |
| 4,168,085 | A | | 9/1979 | Faulin | |
| 4,177,584 | A | | 12/1979 | Beyl | |
| 4,182,525 | A | | 1/1980 | Spademan | |
| 4,261,595 | A | | 4/1981 | Smialowski et al. | |
| 4,270,770 | A | | 6/1981 | Spademan | |
| 4,309,833 | A | | 1/1982 | Salomon | |
| 4,334,367 | A | | 6/1982 | Salomon | |
| 4,352,508 | A | | 10/1982 | Spademan | |
| 4,360,218 | A | * | 11/1982 | Spademan | 280/624 |
| 4,395,055 | A | | 7/1983 | Spademan | |
| 4,398,359 | A | | 8/1983 | Chalmers, II | 36/117.4 |
| 4,415,176 | A | | 11/1983 | Hull et al. | |
| 4,492,387 | A | | 1/1985 | Spademan | |
| 4,536,006 | A | | 8/1985 | Haldemann et al. | |
| 4,562,653 | A | | 1/1986 | Salomon | |
| 4,571,858 | A | | 2/1986 | Faulin | |
| 4,652,007 | A | | 3/1987 | Dennis | |
| 4,728,116 | A | | 3/1988 | Hill | |
| 4,741,550 | A | | 5/1988 | Dennis | |
| 4,836,572 | A | | 6/1989 | Pozzobon | |
| 4,907,353 | A | | 3/1990 | Wittmann et al. | |
| RE33,350 | E | * | 9/1990 | Stuart | 280/624 |
| 4,964,649 | A | | 10/1990 | Chamberlin | |
| 4,973,073 | A | * | 11/1990 | Raines et al. | 280/14.21 |
| 4,995,632 | A | | 2/1991 | Girault et al. | |
| 5,035,443 | A | | 7/1991 | Kincheloe | |
| 5,054,807 | A | | 10/1991 | Fauvet | |
| 5,069,463 | A | | 12/1991 | Baud et al. | |
| 5,156,644 | A | * | 10/1992 | Koehler et al. | 280/14.21 |
| 5,299,823 | A | | 4/1994 | Glaser | |
| 5,435,080 | A | * | 7/1995 | Meiselman | 36/117.1 |
| 5,474,322 | A | | 12/1995 | Perkins et al. | |
| 5,505,477 | A | | 4/1996 | Turner et al. | |
| 5,505,478 | A | * | 4/1996 | Napoliello | 280/618 |
| 5,520,405 | A | | 5/1996 | Bourke | |
| 5,520,406 | A | | 5/1996 | Anderson et al. | |
| 5,558,355 | A | | 9/1996 | Henry | |
| 5,577,757 | A | | 11/1996 | Riepl et al. | |
| 5,595,396 | A | | 1/1997 | Bourdeau | |
| D382,320 | S | * | 8/1997 | Sand | D21/773 |
| 5,954,358 | A | | 9/1999 | Bejean et al. | |

FOREIGN PATENT DOCUMENTS

| | | |
|---|---|---|
| WO | WO 94/26365 | 11/1994 |
| WO | WO 95/09035 | 4/1995 |
| WO | WO 95/33533 A1 | 12/1995 |
| WO | WO 96/01575 | 1/1996 |
| WO | WO 96/03185 A1 | 2/1996 |
| WO | WO 96/05894 | 2/1996 |
| WO | WO 96/17660 A1 | 6/1996 |
| WO | WO 96/26774 A1 | 9/1996 |
| WO | WO 96/36407 | 11/1996 |
| WO | WO 97/04843 A1 | 2/1997 |

* cited by examiner 110
108
66
64
112
38
36
98
96
42
10
76
40
72
68
80
74
70
50
94
78
46
104
48
106
54
44
90
62
100
52
92
60
18
22
102
20
34
12
24
58
56
16
32
28
26
14
88
30
86
84
82

SNOWBOARD BOOT BINDING MECHANISM

CROSS-REFERENCE TO RELATED APPLICATIONS

This application is a continuation of application Ser. No. 08/753,343, filed Nov. 25, 1996, now U.S. Pat. No. 6,050,005, which is a continuation of application Ser. No. 08/674,976, filed Jul. 3, 1996, now U.S. Pat. No. 5,941,555, which is a continuation of application Ser. No. 08/375,971, filed Jan. 20, 1995, now abandoned.

BACKGROUND OF THE INVENTION

1. Field of the Invention

The present invention relates generally to boot binding mechanisms. More specifically, the present invention relates to a snowboard boot binding mechanism that has a pair of engagement rods fixedly attached to a fixed plate and a second pair of engagement rods fixedly attached to a slidably movable plate to selectively engage and lock a snowboard boot in the boot binding mechanism.

2. Description of the Related Art

A recently popular sport, snowboarding presents operating conditions and physical demands to boot bindings that are somewhat dissimilar to other skiing-type sports. That is because in snowboarding, the operator stands with both feet on the snowboard such that both feet are typically disposed at an angle with respect to the longitudinal direction of the ski. Given the sophisticated structure of presently manufactured boots for ski-type sports and the operating conditions the boots are subject to, a reliable and tight connection in between the boot and the snowboard is required.

An attempted solution to this problem is disclosed in U.S. Pat. No. 4,973,073 to Raines et al., issued on Nov. 27, 1990. The boot sole 40 of Raines is modified to have a binding ridge 42, 50 placed on each side of the boot. Ridge 42 is received in a fixed entrapment member 60 and ridge 50 is received by a pivoting entrapment member 70. To release a bound boot 18, the user simply pushes the handle 102 away from the boot until the hooking lip 76 is in an open position and the second binding bridge 50 can be lifted out of the second socket 72. Accordingly, during use the snowboard binding can be rather easily inadvertently opened if handle 102 or any part of member 70 is accidentally pushed away from the boot.

U.S. Pat. No. 4,063,752 to Whittaker issued on Dec. 20, 1977 discloses a ski binding that includes two opposing latch members 28 that each move towards and away from each other to control the latch operation. An engagement plate 32 is secured to the bottom of the boot by screws and has latch receiving formations 34 disposed at its marginal edges.

Notwithstanding the foregoing boot binding mechanisms, there are still major problems involved. The binding mechanisms are typically mounted on the ski or snowboard and are disposed in such a matter that outside forces can easily cause an accidental release of the binding mechanism. Accordingly, it is an object of the present invention to provide a snowboard boot binding mechanism that permits selective engagement and locking of the snowboard boot while simultaneously preventing an inadvertent release of the boot from the locked position. It is a further object of the present invention to provide a boot binding mechanism that includes a base member which acts as a housing to enclose most of the moving parts of the boot binding mechanism to thereby minimize the risk of an accidental release of the binding from the locked position. It is a further object to provide a boot binding mechanism that permits the binding mechanism to clamp the boot sole from the side, i.e., from the in-step area of the foot. It is a further object to provide a snowboard boot binding mechanism that requires less parts and thus, is smaller and easier to manufacture. It is still a further object of the present invention that the snowboard boot binding mechanism be simple and cost effective to manufacture, yet reliable and efficient in use.

SUMMARY OF THE INVENTION

In accordance with a preferred embodiment demonstrating further objects, features and advantages of the invention, a snowboard boot binding mechanism includes a a base member having a recessed channel. A first plate is slidably attached to the base member. A first pair of encasement rods are fixedly attached to the first plate. Each of the first pair of engagement rods have a head disposed at an axial end of the rod for selectively engaging and locking a first bar attached to a first side of the snowboard boot. A second plate is fixedly attached to the base member. A second pair of engagement rods are fixedly attached to the second plate. Each of the second pair of engagement rods having a head disposed at an axial end of the rod for engaging and locking second bar attached to a second side of the snowboard boot which is disposed opposite to the first side.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EMBODIMENTS

Figure 1:
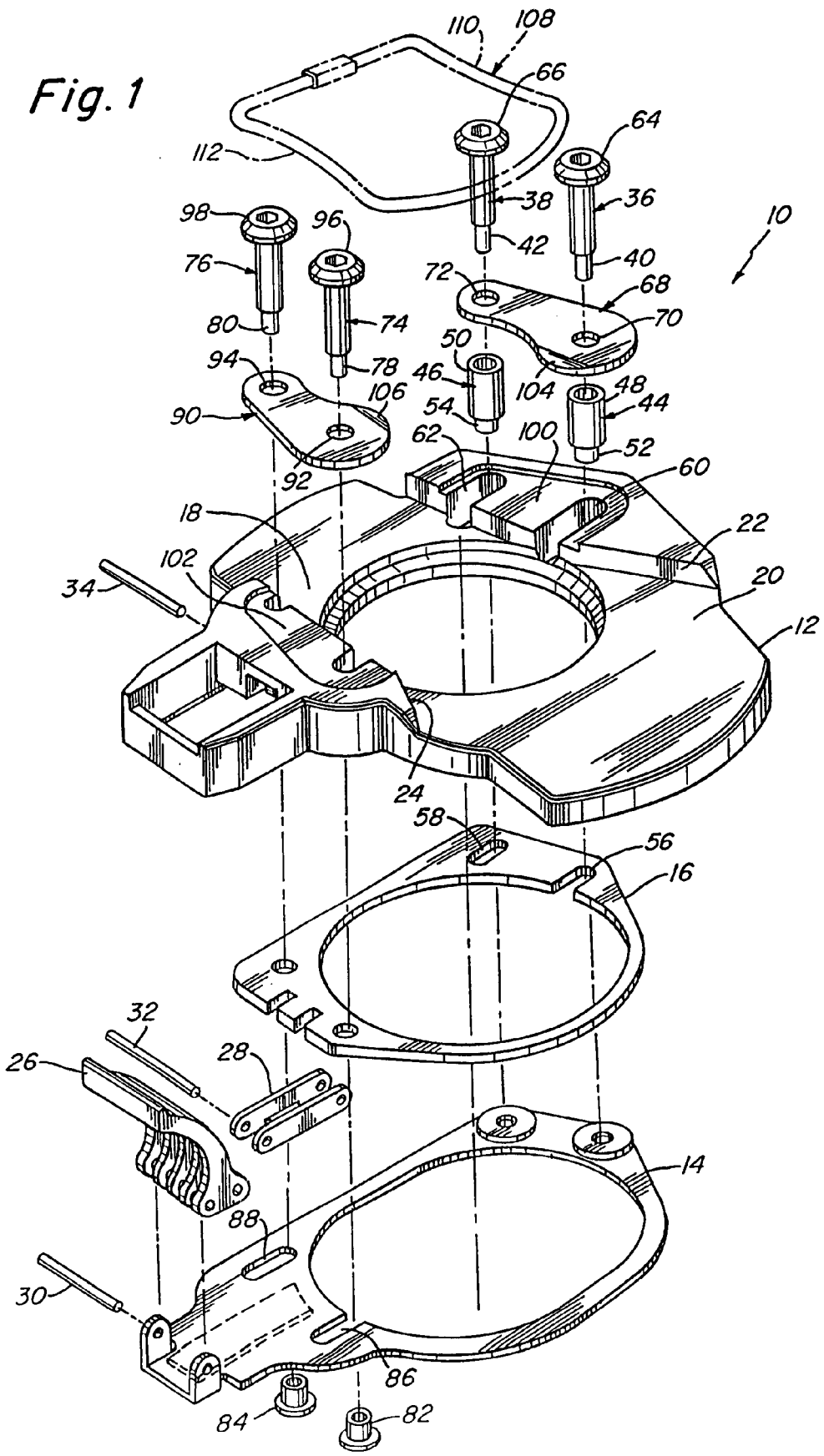
FIG. 1 is an exploded view of a boot binding mechanism according to the present invention.

Referring now to FIG. 1, a snowboard boot binding mechanism 10 is illustrated. The boot binding mechanism includes a base member 12, a first plate 14 and a second plate 16. The base member 12 has a recessed channel 18 the includes an upper surface 20 and two sidewalls surfaces 22, 24 to receive a snowboard boot.

The first plate 14 is slidably attached to base member 12 through a pivoting handle member 26 and a pivoting link arm member 28. A pin 30 is used to pivotally connect handle member 26 to first plate 14. A second pin 32 is used to pivotally connect handle member 26 to link 28. The opposite end of link 28 is pivotally connected to base member 12 by pin 34.

A first pair of engagement rods 36, 38 are fixedly attached to first plate 14. The rods 36, 38 are integrally connected to first plate 14 at their lower axially ends 40, 42, respectively; it being understood that relative orientation adjectives such as "upper", "lower", etc. are utilized herein to simplify the present description and are not intended to limit the orientation of the binding mechanism when mounted for use. The rods 36, 38 are preferably connected to plate 14 by riveting. However, any other suitable means for fixedly attaching the rods to the plate may be used. Each rod 36, 38 passes through a spacer sleeve 44, 46, respectively. Each spacer sleeve 44, 46 has a stepped outer diameter portion including a larger diameter portion 48, 50 and a smaller diameter portion 52, 54, respectively. The smaller diameter portions 52, 54 are received in elongated slots 56, 58, respectively in second plate 16, whereas the larger diameter portions 44, 46 are received in elongated slots 60, 62, respectively, in the base member 12. The upper axially ends of the rods 36, 38 have a head or plate-shaped portion 64, 66. An engagement plate 68 has a pair of throughholes 70, 72 to receive the larger diameter portion of rods 36, 38. Thus, engagement plate 68 is disposed about engagement rods 36, 38 and between head portions 64, 66 and spacer sleeves 44, 46. The spacer sleeves are utilized to help absorb some of the bending forces that may be applied against rods 36, 38. Additionally, engagement plate 68 is used to help transfer some of the bending forces that may be applied to rods 36, 38 into tensile forces. Of course, axial forces in rods 36, 38 are preferred over bending forces.

Figure 2:
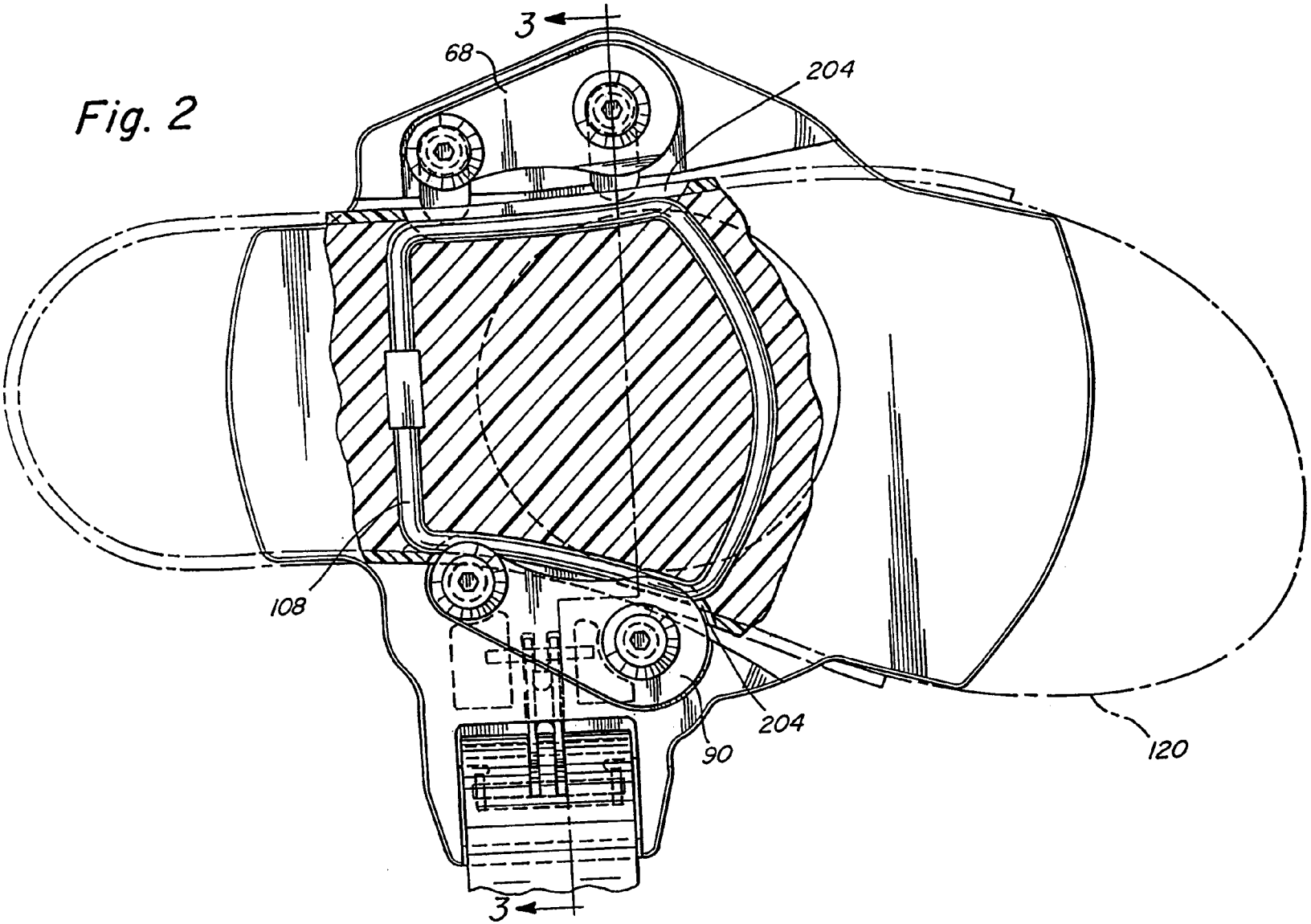
FIG. 2 is a partial sectional top view of a snowboard boot engaged in the boot binding mechanism and in the unlocked position.
Figure 3:
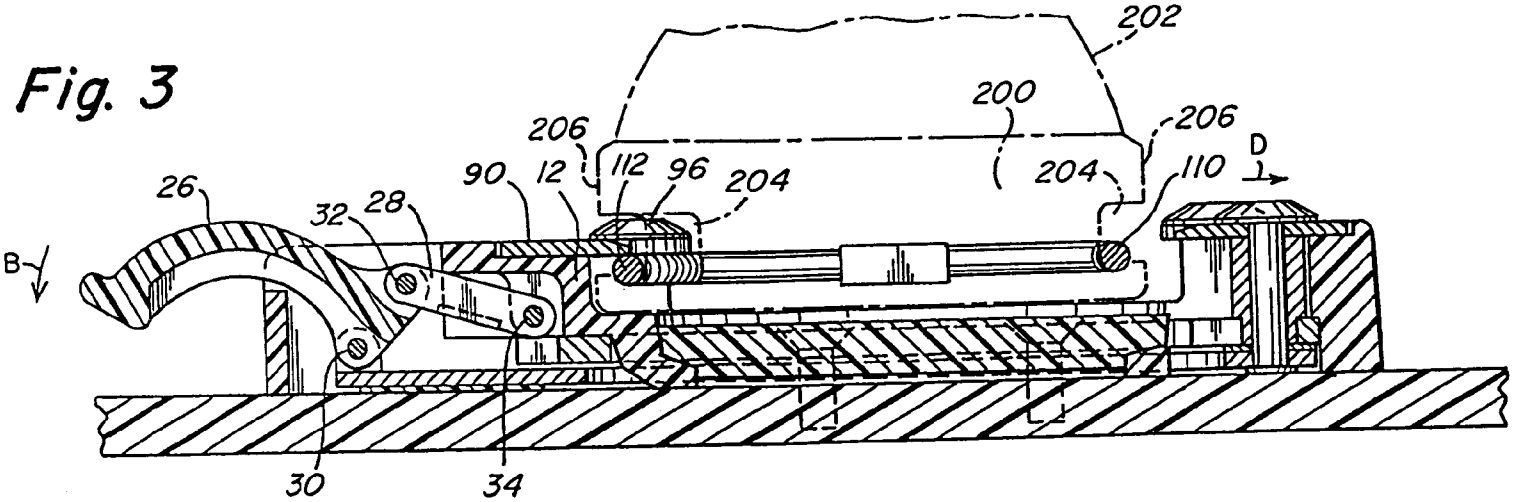
FIG. 3 is a sectional view taken along lines 3—3 of FIG. 2 and looking the direction of the arrows.
Figure 4:
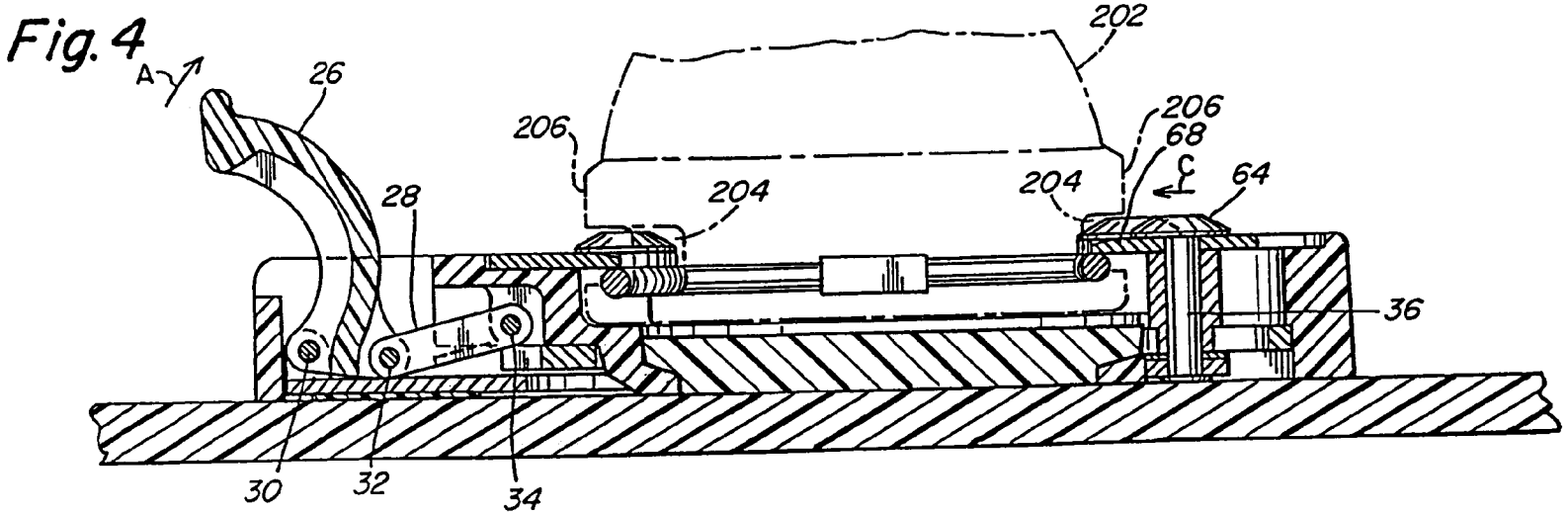
FIG. 4 is a sectional view similar to FIG. 3 except tat the boot binding mechanism is in the locked position.

A second pair of engagement rods 74, 76 are fixedly attached to second plate 16 in a similar manner in which the first pair of engagement rods 36, 38 are fixedly attached to the first plate 14. The pairs of engagement rods are preferably fixedly attached to the plates by a press fit. However, any suitable manner of fixedly attaching these two members together such as welding, shrink-fitting, etc. may be used. The lower ends 78, 80, respectively of the second pair of engagement rods 74, 76 have a reduced diameter portion which are sized to fit within a pair of shoulder bushings 82, 84. The shoulder bushings 82, 84 help guide a sliding motion of the first plate 14 because they are received in elongated slots 86, 88, respectively. A second engagement plate 90 is mounted about the second pair of engagement rods 74, 76 via their respective throughholes 92, 94. Engagement plate 90 is mounted just below the heads 96, 98 of the engagement rods 74, 76, respectively. Engagement plate 68 is slidably supported on a slightly recessed, substantially planer surface 100 in base member 12. Likewise, engagement plate 90 is slidably supported on a slightly recessed, substantially planer support surface 102. Plates 68, 90, also have bevelled edge portions 104, 106 to permit a bar member 108, which is in the form of a closed loop and is embedded in a sole 200 of snowboard boot, to more easily engage into a position below plate 68, 90. Bar member 108 has at least two exposed side portions 110, 112, which correspond to the in-step area of the user's foot. The side portions 110, 112 of the bar member 108 are exposed by a pair of recesses 204. In the embodiment of the invention shown in the drawings, the recesses 204 are disposed in the in-step area of the sole 200 of the boot, and extend only partially across the width of the boot as shown in FIGS. 3–4. Bar member 108 may alternatively not be embedded in the sole, but may be connected to the sole of the snowboard boot, with or without a reinforcing plate depending on the stresses that will be applied to the bar. Side portions 110, 112 are exposed at least along their upper surface, as illustrated in FIGS. 3 and 4 so that the upper portion of the side 110 can be selectively engaged with the first pair of engagement rods 36 and 38 such that the head portions 64, 66 and the engagement plate 68 lock the boot in the binding mechanism as illustrated in FIG. 4. The opposite side 112 of the bar member 108 is exposed along its upper surface to permit head portions 96, 98 of the second pair of engagement rods 74, 76 and engagement plate 90 to engage and to lock the snowboard boot in the binding mechanism when the first plate is in the locked position as illustrated in FIG. 4. As shown from FIGS. 2–4, the bar member 108 is disposed between the heel and ball areas of the boot, and does not extend beyond the lateral sidewalls 206 of the boot, such that the bar 108 is contained within the boundaries of the boot without extending beyond its lateral sides.

The operation of the boot binding mechanism will be described below with reference to FIGS. 2–4. A user wearing a snowboard boot 120 having an upper portion 202 and a closed loop bar member 108 embedded in its sole 200 steps within the open binding mechanism and positions the second side 112 of the bar member 108 into the engaged position below heads 96, 98 and below engagement plate 90 as illustrated in FIGS. 2 and 3.

To lock the boot within the binding mechanism the user then pulls upwardly on handle member 26 in the direction indicated by arrow A in FIG. 4. This upper movement of handle member 26 causes handle member 26 to rotate in the direction indicated by arrow A and to translate in a direction indicated by arrow C in FIG. 4. At the same time, link member 28 pivots about fixed pin 34 in the direction indicated by arrow B, which is opposite to the direction of arrow A. Additionally, simultaneously with the pivoting movements, First plate 14 is slidably moved in the direction indicated by arrow C from the open position as illustrated in FIG. 3 to the closed position as illustrated in FIG. 4. As can be seen in FIGS. 3 and 4, as handle member 26 is pivoted in the upward position, pivot pin 30 slides in the direction indicated by arrow C. When pin 32 passes over an imaginary line extending between pins 30, 34, the handle reaches what is known as a centered position. In this centered position the handle is instable and the handle will then tend to snap into the closed position as illustrated in FIG. 4. In the closed position, the handle is in what is known as an over-centered position. The first set of engagement rods 36, 38 are moved from the open position as illustrated in FIG. 3 to the closed position as illustrated in FIG. 4, such that the heads 64, 66 and the engagement plate 68 selectively engage and lock the first side 110 of the bar member 108 in the boot binding mechanism. If desired, a conventional latch (not shown) may be placed onto handle member 26 to further prevent an inadvertent pivoting of the handle member. However, in most cases the pressure applied from the boot and the base member will be sufficient to maintain the handle in the stable, over-centered position illustrated in FIG. 4.

To unlock the boot, the user simply pushes down and rotates handle member 26 in the direction indicated by arrow B in FIG. 3. Because of the linkage mechanism, this movement will cause handle member 26 to rotate in the direction indicated by arrow. B and to translate in the direction indicated by arrow D. Thus, because of the link between the first plate 14 and the handle member 26, the second plate 14 is slidably moved in the direction indicated by arrow D to the open position as illustrated in FIG. 3. The user can now simply step out of the boot binding mechanism.

Having described the presently preferred exemplary embodiment of a new and improved snowboard boot binding mechanism, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What is claimed is:

1. An apparatus comprising:

a snowboard boot including at least one recess disposed on a lateral side of the snowboard boot; and at least one binding engagement member, supported by the snowboard boot, having a portion thereof that is exposed by the at least one recess and is engageable with a snowboard binding to secure the snowboard boot to a snowboard;

wherein the at least one recess includes first and second recesses respectively disposed on first and second lateral sides of the snowboard boot, and wherein the at least one binding engagement member includes first and second engagement members that are respectively exposed by the first and second recesses, the first and second engagement members being formed from a single unitary member; and wherein the first and second engagement members are contained within the boundaries of the snowboard boot without extending beyond the lateral sides of the snowboard boot.

2. An apparatus comprising:

a snowboard boot having an upper portion and a sole, the snowboard boot having first and second lateral sidewalls, a heel area and a toe area, the snowboard boot having a heel-to-toe direction and a side-to-side direction; and at least one binding engagement member, connected to the snowboard boot, having a portion thereof that is engageable with a snowboard binding to secure the snowboard boot to a snowboard, the engageable portion of the at least one engagement member being disposed substantially in-line with one of the first and second lateral sidewalls of the snowboard boot, the engageable portion of the at least one engagement member being a bar;

wherein the engageable portion of the at least one engagement member extends in the heel-to-to direction; and wherein the engageable portion of the at least one engagement member is circular in cross-section.

3. An apparatus comprising:

a snowboard boot having an upper portion and a sole, the snowboard boot having first and second lateral sidewalls, a heel area and a toe area, the snowboard boot having a heel-to-toe direction and a side-to-side direction; and at least one binding engagement member, connected to the snowboard boot, having a portion thereof that is engageable with a snowboard binding to secure the snowboard boot to a snowboard, the engageable portion of the at least one engagement member being disposed substantially in-line with one of the first and second lateral sidewalls of the snowboard boot, the engageable portion of the at least one engagement member being a bar;

wherein the snowboard boot includes an in-step region, and wherein the engageable portion of the at least one engagement member is disposed in the in-step region of the snowboard boot;

wherein the engageable portion of the at least one engagement member is circular in cross-section;

wherein the at least one engagement member is connected to the sole of the snowboard boot without being embedded therein:

wherein the engageable portion of the at least one engagement member extends in the heel-to-toe direction; and wherein the apparatus has a recess that exposes the engageable portion of the at least one engagement member.

4. An apparatus comprising:

a snowboard boot having an upper portion and a sole, the snowboard boot having first and second lateral sidewalls, a heel area and a toe area, the snowboard boot having a heel-to-toe direction and a side-to-side direction; and at least one binding engagement member, connected to the snowboard boot, having a portion thereof that is engageable with a snowboard binding to secure the snowboard boot to a snowboard, the engageable portion of the at least one engagement member being disposed substantially in-line with one of the first and second lateral sidewalls of the snowboard boot, the engageable portion of the at least one engagement member being a bar;

wherein the apparatus has a recess that exposes the engageable portion of the at least one engagement member.

5. The apparatus recited in claim 4, wherein the engageable portion of the at least one engagement member is circular in cross-section.

6. The apparatus recited in claim 4, wherein the at least one engagement member is connected to the sole of the snowboard boot without being embedded therein.

7. The apparatus recited in claim 6, wherein the snowboard boot includes an in-step region, and wherein the engageable portion of the at least one engagement member is disposed in the in-step region of the snowboard boot.

8. An apparatus comprising:

a snowboard boot having an upper portion and a sole, the snowboard boot having first and second lateral sidewalls, a heel area and a toe area, the snowboard boot having a heel-to-toe direction and a side-to-side direction, and at least one binding engagement member, connected to the snowboard boot, having a portion thereof that is engageable with a snowboard binding to secure the snowboard boot to a snowboard, the engageable portion of the at least one engagement member being disposed substantially in-line with one of the first and second lateral sidewalls of the snowboard boot, the engageable portion of the at least one engagement member being a bar;

wherein the at least one binding engagement member includes first and second binding engagement members that respectively have engageable portions that are disposed substantially in-line with the first and second lateral sidewalls of the snowboard boot, the engageable portions of each of the first and second binding engagement members being a bar; and wherein the engageable portions of the first and second binding engagement members are circular in cross-section;

wherein each of the first and second binding engagement members is connected to the sole of the snowboard boot without being embedded therein; and wherein the apparatus has at least one recess that exposes the engageable portions of the first and second binding engagement members.

9. The apparatus recited in claim 8, wherein the snowboard boot includes an in-step region, and wherein the engageable portions of the first and second binding engagement members each is disposed in the in-step region of the snowboard boot.

10. The apparatus recited in claim 9, wherein the engageable portions of the first and second binding engagement members each extends in the heel-to-toe direction.

11. The apparatus recited in claim 9, wherein the engageable portion of the at least one engagement member extends in the heel-to-toe direction.

12. An apparatus, comprising:

a snowboard boot having an upper portion and a sole, the snowboard boot having first and second lateral sidewalls, a heel area and a toe area, the snowboard boot having a heel-to-toe direction and a side-to-side direction; and at least one binding engagement member, connected to the snowboard boot, having a portion thereof that is engageable with a snowboard binding to secure the snowboard boot to a snowboard, the engageable portion of the at least one engagement member being disposed substantially in-line with one of the first and second lateral sidewalls of the snowboard boot;

wherein the apparatus includes at least one recess that is adapted to expose the engageable portion of the at least one engagement member, the engageable portion of the at least one engagement member being disposed within the recess.

13. The apparatus recited in claim 12, wherein the engageable portion of the at least one engagement member extends in the heel-to-toe direction.

14. The apparatus of claim 13, in combination with the snowboard binding.

15. The apparatus recited in claim 12, wherein the snowboard boot includes an in-step region, and wherein the engageable portion of the at least one engagement member is disposed in the in-step region of the snowboard boot.

16. The apparatus recited in claim 15, wherein the engageable portion of the at least one engagement member is circular in cross-section.

17. The apparatus recited in claim 12, wherein the at least one binding engagement member includes first and second binding engagement members that respectively have engageable portions that are disposed substantially in-line with the first and second lateral sidewalls of the snowboard boot and that each extends in the heel-to-toe direction, the engageable portions of each of the first and second binding engagement members being exposed by the at least one recess.

18. The apparatus recited in claim 17, wherein the engageable portions of the first and second binding engagement members each is circular in cross-section.

19. The apparatus recited in claim 12, wherein the engageable portion of the at least one engagement member is a bar.

20. The apparatus recited in claim 12, wherein the engageable portion of the at least one engagement member is circular in cross-section.

21. The apparatus recited in claim 12, wherein the at least one engagement member is connected to the sole of the snowboard boot without being embedded therein.

22. The apparatus recited in claim 12, wherein the at least one engagement member is integrated into the snowboard boot.

23. The apparatus of claim 12, in combination with the snowboard binding.

24. An apparatus comprising:

a snowboard boot having an upper portion and a sole, the boot having first and second lateral sidewalls; and at least one binding engagement member, connected to the sole, having a portion thereof that is engageable with a snowboard binding to secure the snowboard boot to a snowboard, the engageable portion of the at least one binding engagement member being a bar that is circular in cross-section and is contained between the first and second lateral sidewalls of the boot without extending beyond either of the first and second lateral sidewalls;

wherein the at least one binding engagement member is embedded in the sole;

wherein the sole includes a recess that exposes the engageable portion of the at least one binding engagement member; and wherein the recess is disposed in the first lateral sidewall of the boot.

25. An apparatus, comprising:

a snowboard boot having an upper portion and a sole, a heel area and a toe area, the snowboard boot having a heel-to-toe direction and a side-to-side direction; and at least one binding engagement member, connected to the snowboard boot, having a portion thereof that is engageable with a snowboard binding to secure the snowboard boot to a snowboard;

wherein the apparatus has a lateral sidewall and includes at least one recess, disposed in the lateral sidewall, that is adapted to expose the engageable portion of the at least one engagement member, the engageable portion of the at least one engagement member being disposed within the recess.

26. The apparatus recited in claim 25, wherein the engageable portion of the at least one engagement member is a bar that is circular in a cross-section taken in the side-to-side direction of the snowboard boot.

27. The apparatus recited in claim 25, wherein the apparatus includes first and second lateral sidewalls, and wherein the at least one binding engagement member is contained between the first and second lateral sidewalls of the apparatus without extending beyond either of the first and second lateral sidewalls.

28. The apparatus recited in claim 25, wherein the at least one engagement member is connected to the sole of the snowboard boot without being embedded therein.

29. The apparatus recited in claim 25, wherein the at least one engagement member is disposed substantially in-line with the lateral sidewall of the apparatus.

30. The apparatus of claim 25, in combination with the snowboard binding.

31. An apparatus comprising:

a snowboard boot having an upper portion and a sole, the snowboard boot having first and second lateral sidewalls, a heel area and a toe area, the snowboard boot having a heel-to-toe direction and a side-to-side direction; and at least one binding engagement member, connected to the snowboard boot, having a portion thereof that is engageable with a snowboard binding to secure the snowboard boot to a snowboard, the engageable portion of the at least one engagement member being disposed substantially in-line with one of the first and second lateral sidewalls of the snowboard boot, the engageable portion of the at least one engagement member being a bar;

wherein the at least one engagement member comprises a closed loop bar member.

32. An apparatus, comprising:

a snowboard boot having an upper portion and a sole, the snowboard boot having first and second lateral sidewalls, a heel area, a toe area and an in-step region, the snowboard boot having a heel-to-toe direction and a side-to-side direction; and a binding engagement member, connected to the snowboard boot, having first and second portions that are engageable with a snowboard binding to secure the snowboard boot to a snowboard, the first engageable portion of the engagement member being disposed substantially in-line with the first lateral sidewall of the snowboard boot, the second engageable portion of the engagement member being disposed substantially in-line with the second lateral sidewall of the snowboard boot;

wherein the apparatus comprises a first recess in the first lateral sidewall that is adapted to expose an upper surface of the first engageable portion of the binding engagement member and a second recess in the second lateral sidewall that is adapted to expose an upper surface of the second engageable portion of the binding engagement member; and wherein the first and second engageable portions of the binding engagement member are disposed in the in-step region.

33. The apparatus of claim 32, wherein the first engageable portion of the binding engagement member does not extend outwardly beyond the first lateral sidewall, and wherein the second engageable portion of the binding engagement member does not extend outwardly beyond the second lateral sidewall.

34. The apparatus of claim 32, wherein the first engageable portion of the binding engagement member follows a contour of the first lateral sidewall and the second engageable portion of the binding engagement member follows a contour of the second lateral sidewall.

35. The apparatus of claim 32, wherein the first engageable portion of the binding engagement member extends along the first lateral sidewall and the second engageable portion of the binding engagement member extends along the second lateral sidewall.

36. The apparatus recited in claim 32 wherein each of the first and second engageable portions has a length in the heel-to-to direction and a width in the side-to-side direction, and wherein the length is greater than the width for each of the first and second engageable portions.

37. The apparatus of claim 32, wherein at least one of the first and second engageable portions is linear.

38. The apparatus of claim 32, wherein the binding engagement member is connected to the snowboard boot at the sole, and wherein the first and second engageable portions are respectively disposed in-line with the first and second lateral sidewalls at the sole.

39. The apparatus of claim 38, wherein the first engageable portion of the binding engagement member does not extend outwardly beyond the first lateral sidewall at the sole, and wherein the second engageable portion of the binding engagement member does not extend outwardly beyond the second lateral sidewall at the sole.

40. The apparatus of claim 38, wherein the first engageable portion of the binding engagement member follows a contour of the first lateral sidewall at the sole and the second engageable portion of the binding engagement member follows a contour of the second lateral sidewall at the sole.

41. The apparatus of claim 32, in combination with the snowboard binding.

42. The combination of claim 41, wherein the snowboard binding is a non-releasable snowboard binding.

43. The combination of claim 41, wherein the snowboard binding comprises first and second boot engagement members that are spaced apart to receive the boot between them, wherein the first boot engagement member engages the first engageable portion of the binding engagement member from outside the first lateral side of the boot, and the second boot engagement member engages the second engageable portion of the binding engagement member from outside the second lateral side of the boot.

44. The combination of claim 41, wherein the snowboard binding comprises first and second boot engagement members that are spaced apart to receive the boot between them, wherein the first boot engagement member is adapted to be received in the first recess to engage the first engageable portion of the binding engagement member, and wherein the second boot engagement member is adapted to be received in the second recess to engage the second engageable portion of the binding engagement member.

45. The combination of claim 44, wherein the first boot engagement member comprises a first pair of engagement lobes that engage the first engageable portion of the binding engagement member at a pair of spaced apart positions, and wherein the second boot engagement member comprises a second pair of engagement lobes that engage the second engageable portion of the binding engagement member at a pair of spaced apart positions.

46. An apparatus comprising:

a snowboard boot including a first recess disposed on a first lateral side of the snowboard boot and a second recess disposed on a second lateral side of the snowboard boot, the snowboard boot having an upper portion, a sole, a heel area, a toe area and an in-step region, the snowboard boot further having a heel-to-toe direction and a side-to-side direction; and a binding engagement member, connected to the snowboard boot, having first and second portions that are engageable with a snowboard binding to secure the snowboard boot to a snowboard, the first engageable portion having an upper surface exposed by the first recess in the first lateral sidewall, the second engageable portion having an upper surface exposed by the second recess in the second lateral sidewall;

wherein the first and second recesses both are disposed in the in-step region of the snowboard boot.

47. The apparatus of claim 46, wherein the first and second engageable portions of the binding engagement member are disposed in the in-step region.

48. The apparatus of claim 46, wherein the first engageable portion of the binding engagement member does not extend outwardly beyond the first lateral sidewall, and wherein the second engageable portion of the binding engagement member does not extend outwardly beyond the second lateral sidewall.

49. The apparatus of claim 46, wherein the first engageable portion of the binding engagement member follows a contour of the first lateral sidewall and the second engageable portion of the binding engagement member follows a contour of the second lateral sidewall.

50. The apparatus of claim 46, wherein the first engageable portion of the binding engagement member extends along the first lateral sidewall and the second engageable portion of the binding engagement member extends along the second lateral sidewall.

51. The apparatus recited in claim 46, wherein each of the first and second engageable portions has a length in the heel-to-to direction and a width in the side-to-side direction, and wherein the length is greater than the width for each of the first and second engageable portions.

52. The apparatus of claim 46, wherein at least one of the first and second engageable portions is linear.

53. The apparatus of claim 46, wherein the binding engagement member is connected to the snowboard boot at the sole.

54. The apparatus of claim 53, wherein the first engageable portion of the binding engagement member does not extend outwardly beyond the first lateral sidewall at the sole, and wherein the second engageable portion of the binding engagement member does not extend outwardly beyond the second lateral sidewall at the sole.

55. The apparatus of claim 53, wherein the first engageable portion of the binding engagement member follows a contour of the first lateral sidewall at the sole and the second engageable portion of the binding engagement member follows a contour of the second lateral sidewall at the sole.

56. The apparatus of claim 46, in combination with the snowboard binding.

57. The combination of claim 46, wherein the snowboard binding is a non-releasable snowboard binding.

58. The combination of claim 46, wherein the snowboard binding comprises first and second boot engagement members that are spaced apart to receive the boot between them, wherein the first boot engagement member engages the first engageable portion of the binding engagement member from outside the first lateral side of the boot, and the second boot engagement member engages the second engageable portion of the binding engagement member from outside the second lateral side of the boot.

59. The combination of claim 46, wherein the snowboard binding comprises first and second boot engagement members that are spaced apart to receive the boot between them, wherein the first boot engagement member is adapted to be received in the first recess to engage the first engageable portion of the binding engagement member, and wherein the second boot engagement member is adapted to be received in the second recess to engage the second engageable portion of the binding engagement member.

60. The combination of claim 59, wherein the first boot engagement member comprises a first pair of engagement lobes that engage the first engageable portion of the binding engagement member at a pair of spaced apart positions, and wherein the second boot engagement member comprises a second pair of engagement lobes that engage the second engageable portion of the binding engagement member at a pair of spaced apart positions.

* * * * *